United States Patent [19]

Varga et al.

[11] 4,027,578

[45] June 7, 1977

[54] DEVICE FOR ATTACHING BOX HANDLES

[75] Inventors: Leroy M. Varga, Dover; Robert B. Fitch, Montville, both of N.J.

[73] Assignee: Rockaway Corporation, Rockaway, N.J.

[22] Filed: Apr. 8, 1976

[21] Appl. No.: 674,971

[52] U.S. Cl. ..... 93/36.7; 53/134

[51] Int. Cl.[2] ..... B31B 1/86

[58] Field of Search ..... 93/36.7; 53/134, 138; 229/52 AL; 217/12, 125

[56] References Cited

UNITED STATES PATENTS

| | | | |
|---|---|---|---|
| 2,601,816 | 7/1952 | Arneson | 93/36.7 |
| 3,563,433 | 2/1971 | Yoshiura et al. | 229/52 AL X |
| 3,834,970 | 9/1974 | Mitsuoka et al. | 93/36.7 X |

*Primary Examiner*—Roy Lake

*Assistant Examiner*—E. F. Desmond

*Attorney, Agent, or Firm*—Pasquale A. Razzano

[57] ABSTRACT

A device for securing a web handle to a container blank includes a feed station having means for storing a supply of blanks above a conveyor which removes individual blanks from the feed station and carries the blanks therewith, with one edge of the blanks facing in the direction of travel of the conveyor. A web handle supply station is located downstream of the storage station in the direction of travel of the conveyor and includes means for supplying and positioning a web handle of predetermined length to a blank on the conveyor immediately therebelow, with the ends of the web handle located in front of the leading edge of the blank. Means, such as for example a stapling machine, are located downstream of the web supply station for securing the web handle to the container end blank.

29 Claims, 14 Drawing Figures

26
42
14
18
260
270
60
58
54
242
244
240
230
247
56
20
82
86
86
76
62
96
7
7
70
98
18
100
84
64
16
50
52

12
26
36
33
24
250
260
200
210
212
216
252
244
72
74
76
230

DEVICE FOR ATTACHING BOX HANDLES

The present invention relates to devices for attaching box handles to a container; and more particularly to an apparatus for attaching a handle to a box end section.

In many types of applications it is often necessary that a container or box have a handle secured thereto; this is true even in wooden wirebound box type constructions. In that type of construction it is not readily feasible to form the handle in the wooden ends of the box itself, and therefore a web handle is secured to the box in some conventient manner. More particularly the handle is secured to the end sections of the wirebound box. In certain applications it is necessary that the handle have a moebius type of twist (i.e. a 180° twist along its longitudinal axis) from one end to the other, so that the handle provides a flat surface on which the person moving the box can place his hand. Without such a twist the handle would tend to roll up into a thin strip when it was grasped. This type of handle requirement is often used in military ammunition wooden box constructions.

An object of the present invention is to provide a device which is adapted to secure a web handle on the end blank of a wooden box structure.

Another object of the present invention is to provide a device which is adapted to form a moebius type twist in a web handle as it is in the process of being secured to a box end blank.

A further object of the present invention is to provide an apparatus for placing a web handle on a box end blank which is relatively simple in construction and durable in operation.

In accordance with an aspect of the present invention a device for securing a web handle to a box end blank includes a feed station having means for storing a supply of wooden box end blanks in a generally vertical stack, with the ends of the blanks lying substantially horizontally and with the upper and lower surfaces of the blanks engaged at least one adjacent blank in the stack. A conveyor for transporting individual blanks through the device passes through the feed station below the stack of blanks and includes means for sequentially removing the lowermost blank from the stack and carrying the blank therewith.

A web handle supply station is located downstream of the storage station in the direction of travel of the conveyor and includes means for supplying web handle material to the supply station in a generally vertical direction with the free end of the material positioned adjacent one end of a blank immediately therebelow. A cutting apparatus is provided to cut the material into sections of predetermined length at the web supply station, by cutting the material at a predetermined distance above the blank. This forms a new free end of the supply of web handle material and a second free end on the cut supply of web handle material and a second free end on the cut handle section. A rotatable and translatable web engaging arm is provided in the web supply station for engaging this second free end of the cut handle section as it is cut and transporting it vertically downwardly to a position adjacent said one end of the blank while simultaneously forming a moebius type twist in the cut handle section. The conveyor transports the box end and the twisted web handle section from the supply station to a device, such as for example a stapling machine, which secures the cut web handle section to the box end blank.

The above, and other objects, features and advantages of this invention will be apparent in the following detailed description of an illustrative embodiment thereof, which is to be read in connection with the accompanying drawings, wherein.

Figure 7:
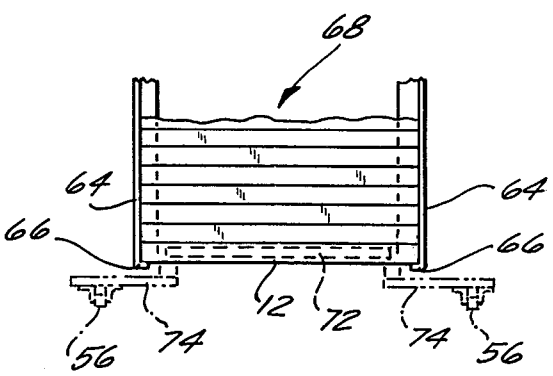
Figures 3, 8:
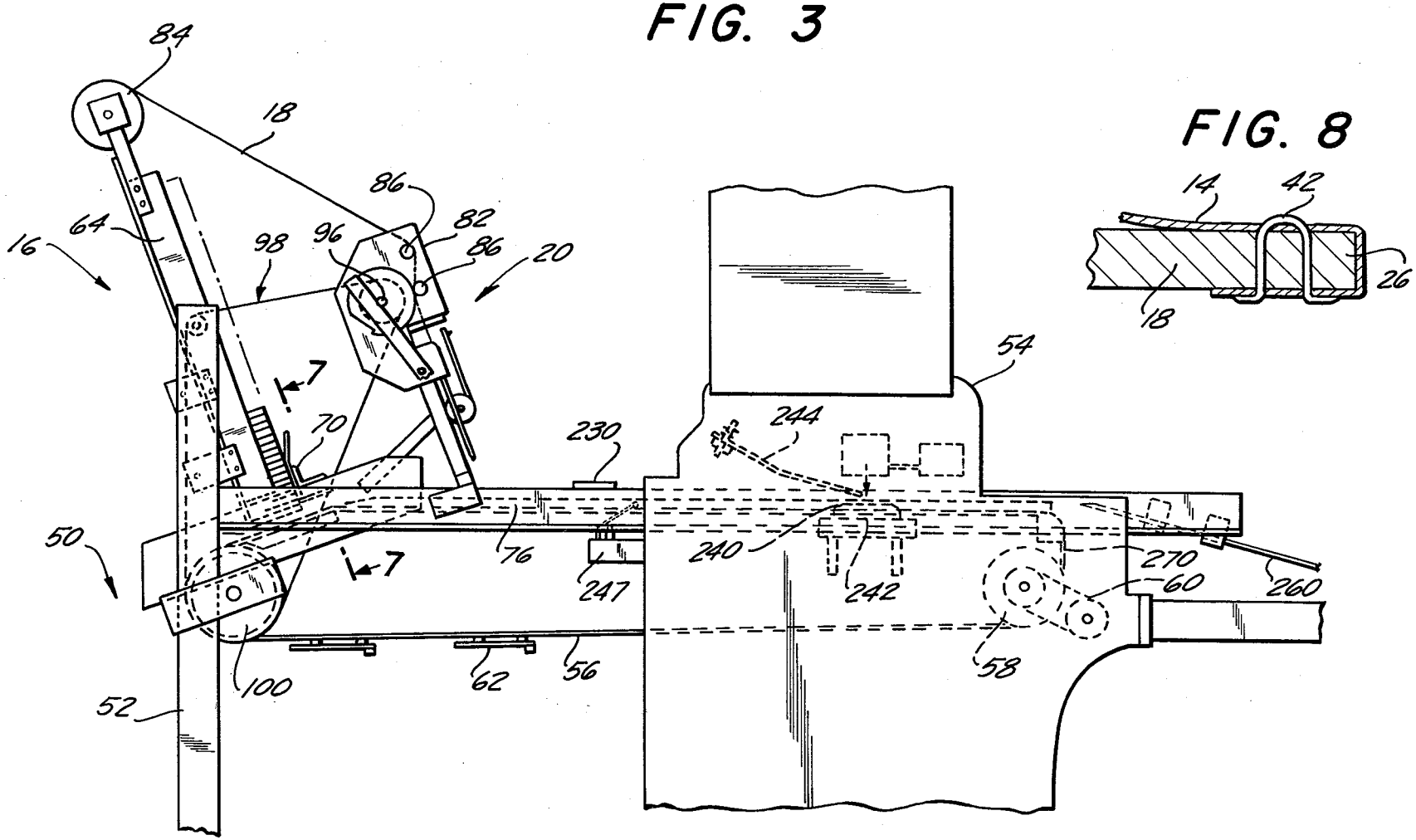
FIG. 3 is a side elevational view of an apparatus constructed in accordance with the present invention.
Figures 4, 4A:
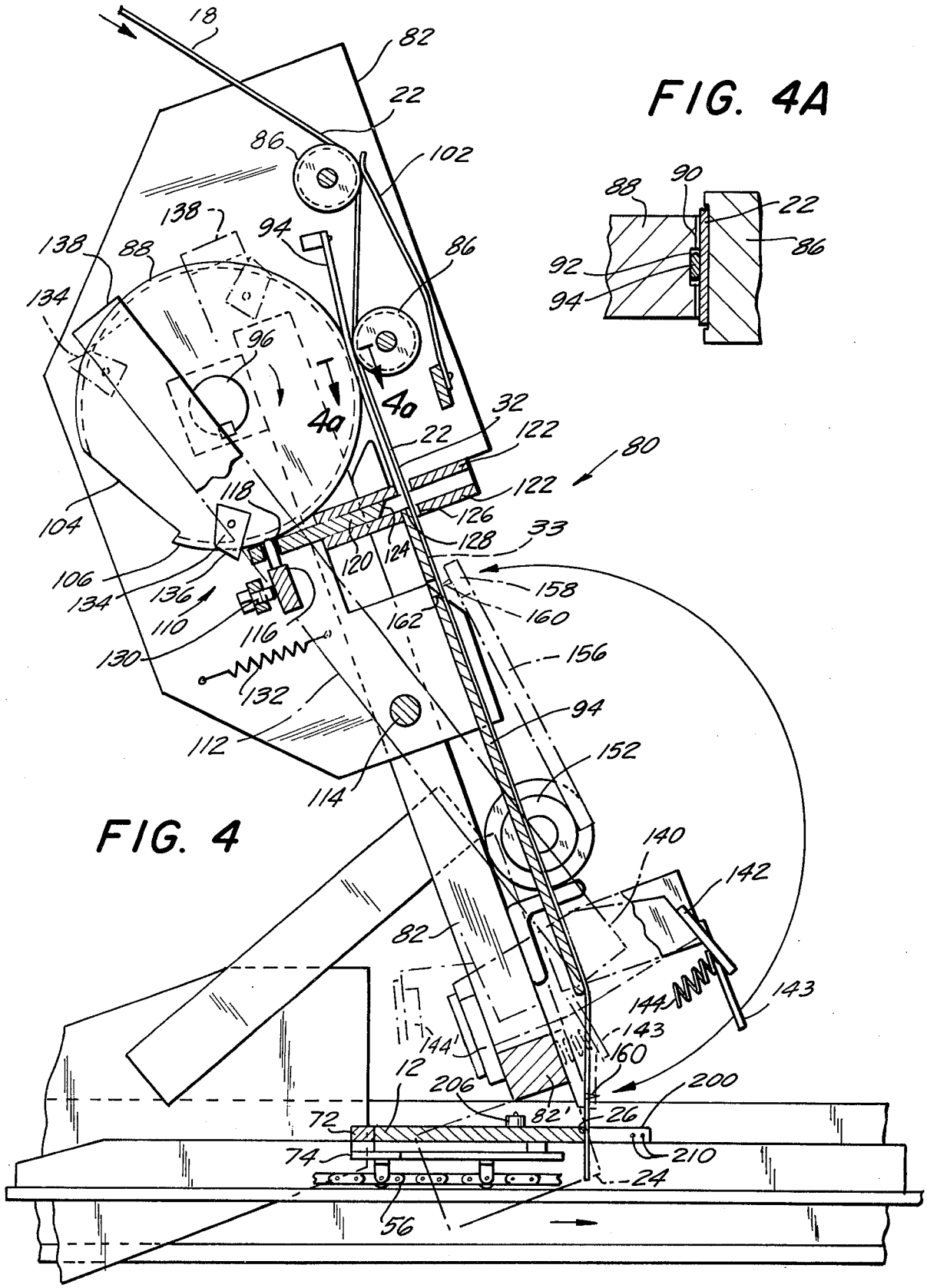
FIG. 4 is an enlarged side view, partly in section, of the web supply station of the apparatus.
Figure 5:
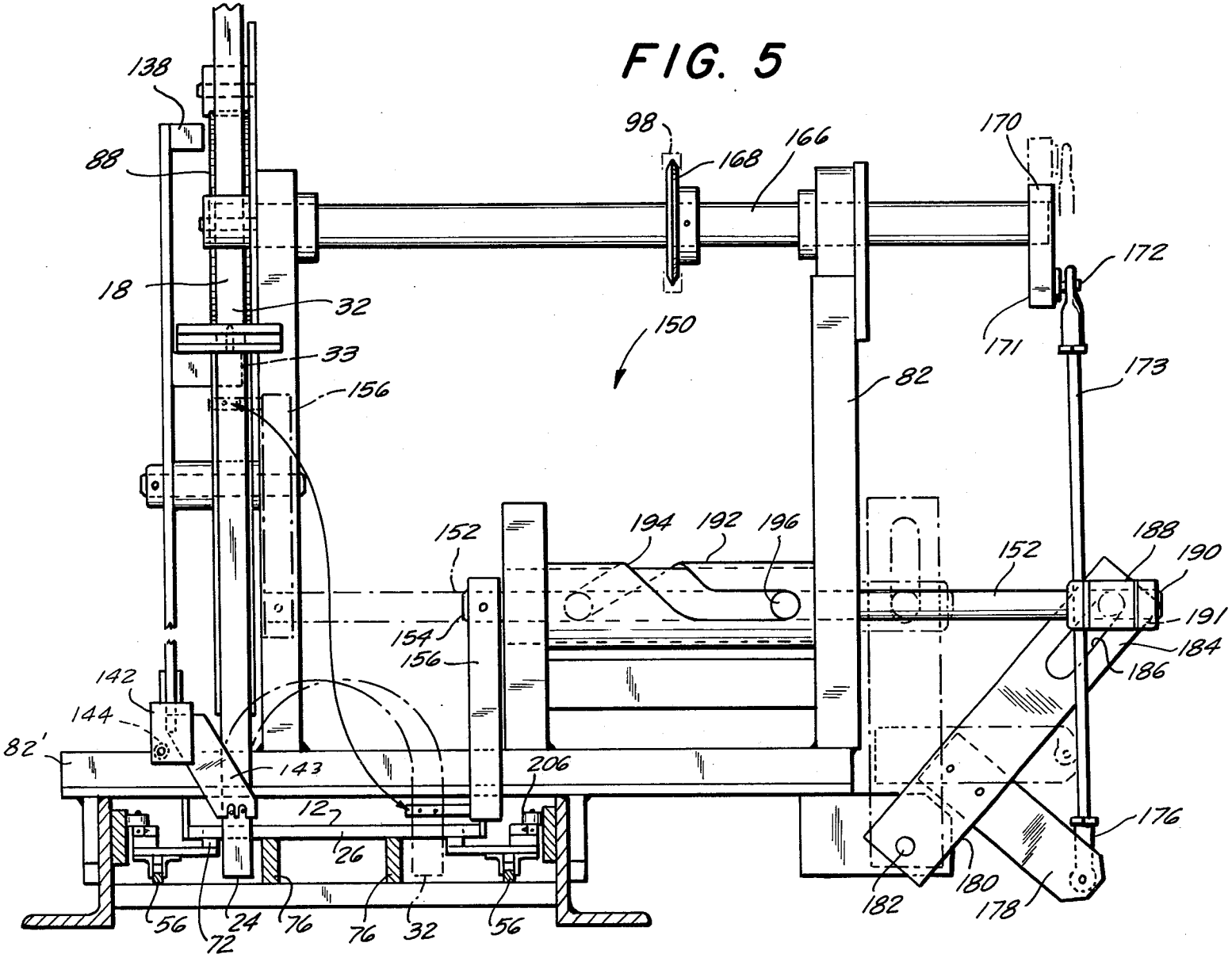

FIG. **4*a* is a sectional view taken along line 4*a*—4*a* of FIG. 4**;

FIG. 5 is a front view of the web supply station of the apparatus;

FIGS. 6A—6F are sequential plan views showing the conveyor mechanism of the apparatus as it transports a box end through the various process steps performed by the apparatus of the present invention;

FIG. 7 is a front end view taken along line 7—7 of FIG. 3 showing the box end stacking or storing station; and FIG. 8 is an enlarged side sectional view showing one end of the web handle stapled to the box end blank.

Figure 1:
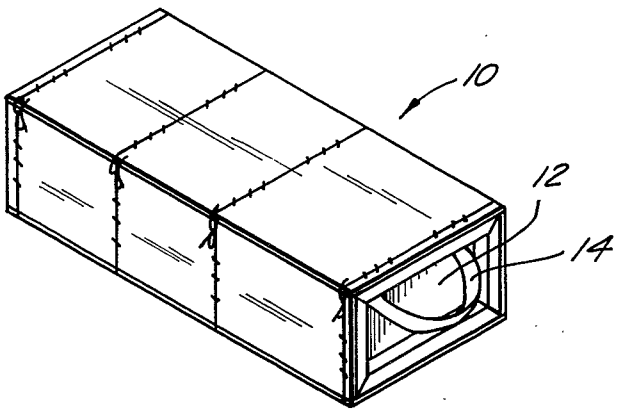
FIG. 1 is a perspective view of a wirebound box having a web handle mounted thereon.

Referring now to the drawing in detail, and initially to FIG. 1 thereof, a conventional wirebound box 10 is illustrated which is formed of wooden slat and cleat construction. The box includes end sections 12 formed of resawn lumber to which a web type handle 14 formed of nylon webbing or the like is secured. The box is constructed in accordance with well known procedures on wirebound box stapling machines such as are commercially available from the Stapling Machines Company of Rockaway, N.J.

In accordance with the present invention an apparatus is provided which is adapted to place the web handle 14 on the wooden end blank 12 of the container before the container is assembled. In particular the apparatus places the handle on the wooden end blank of the box automatically and with a moebius type twist. When the handle is used it provides a hand pick up with the entire surface of the web engaging the hand to distribute the weight of the box along the hand.

Figure 2:
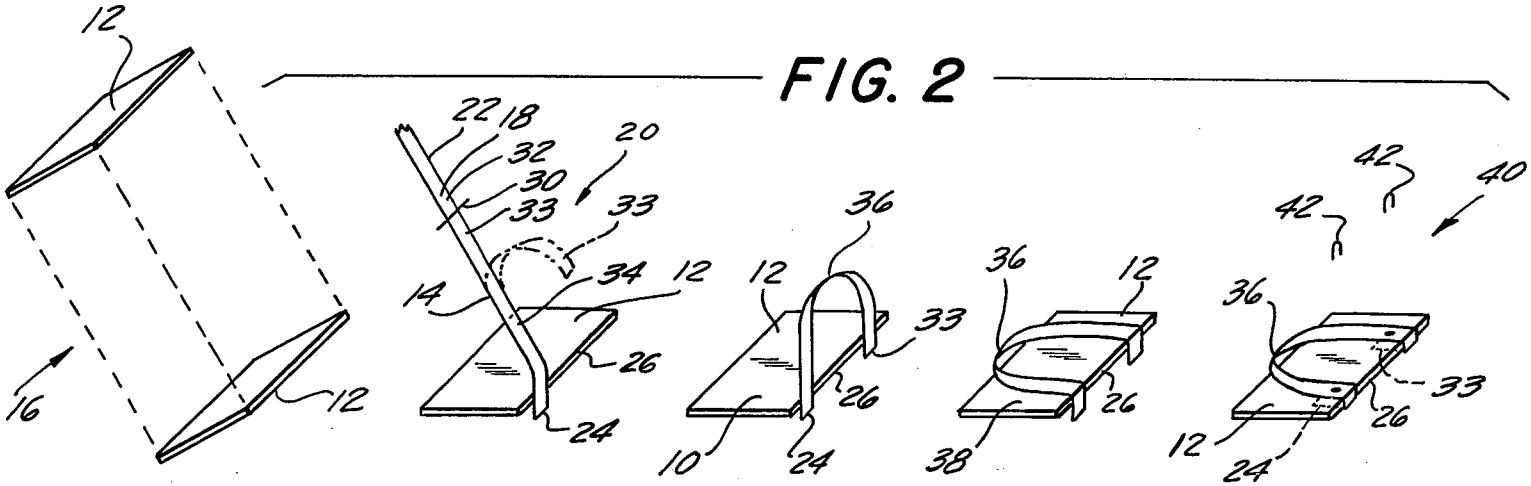
FIG. 2 is a diagrammatic sequential view illustrating the steps involved in placing a web handle on a box end section according to the present invention.

The sequence of steps performed by the apparatus of the present invention is illustrated in FIG. 2. As seen therein a stack 16 of wooden end blanks 12 is provided (to the left of the figure), with the bottommost blank 12 being sequentially removed from the stack during operation of the apparatus, as described hereinafter. The removed blank is transported through the apparatus to a web supply station 20 at which a continuous supply 22 of web material 18 is provided. The web material is cut into individual web handles 14 at station 20 in a sequential operation after the lowermost end 24 of the web supply is first positioned at the level of the leading edge 26 of the blank 12. Thereafter a cut 30 is made at a predetermined position above the end blank to form a new end portion 33 on the web material 18, thereby to separate the cut web handle section 14 from the supply. The end 33 of the cut length section 14 is then brought down to position adjacent the front end 26 of the blank 12. In this operation the outwardly facing side 34 of the web, i.e. the side of the web facing in the direction of travel of the end blank is brought down and placed against the leading edge 26 of the blank. Thus opposite sides of the web engage the edge 26 of the blank at each of the ends 24, 33. This results in the formation of a moebius type twist 36 in the web handle so that the handle provides a flat surface for the hand when inserted for lifting of the box.

After positioning of the web handle 14 in this manner the handle is urged downwardly against the top surface 38 of the box end blank as it is transported towards a securing or stapling station 40. At that station the free ends 24, 33 of the webs are urged upwardly against the lower surface of the box end blank by the clincher mechanism of a conventional stapling machine and staples 42 are driven through the web material and the wooden end blank 12 in order to secure the handle to the blank (see FIG. 8). The blank can now be used to form the ends of the wirebound box 10, in the conventional manner.

Referring now to FIG. 3 of the drawing it is seen that the apparatus 50 of the present invention includes a frame 52 associated with a conventional stapling machine 54, of the ytpe available from the Stapling Machines Company of Rockaway, N.J., which is adapted for use in forming wirebound boxes. Such machines include adjustable stapling heads that can be adapted to a variety of uses and sizes.

An endless conveyor 56 is positioned to travel through frame 52 and stapling machine 54 and is operatively connected through a sprocket 58 or the like to the drive mechanism 60 of the stapling machine. The conveyor is of the endless chain type, and includes apparatus 62, as described hereinafter, which will remove the bottomost box end blank 12 from the box storage station 16 and carry the blank with it through the apparatus and the stapling machine.

The box end blank storage station 16 includes, as seen in FIGS. 3 and 7, a pair of channel shaped side wall bars 64 having internal flanges 66 on their lower end which support the lowermost container end blank 12 in the stack 68 of blanks. It also includes a transverse guide bar 70 extending across bars 64 which hold the lowermost series of blanks in the frame elements. and prevent outward movement of the blanks in the direction of travel of the conveyor as the lowermost 12 is removed therefrom.

Removal of the lowermost blank 12 is accomplished by means of a pusher bar 72 mounted on support elements 74 secured, in any convenient manner, to the opposite ends of the pusher bar and to the chain conveyor 56. The bar is positioned so that it passes between channel bars 64 and above flanges 66 to engage the lowermost blank 12 of the stack 68 and push the blank forwardly.

Immediately adjacent the box end storage station 16, and extending therefrom towards the stapling machine 52 are at least one pair of runners 76 on which the blank 12 rests and slides during movement along frame 52 into the stapling machine 54. Thus the box end blank is supported on bars 76 (which are secured to frame 52 in any convenient manner) and is pushed therealong by the pusher element 72 of the conveyor.

The web supply station 20 is located at a predetermined distance downstream from the box end storage station 16. This station, as seen in FIGS. 3 and 4 includes a subframe 82 mounted on frame 52 in any convenient manner. A supply 84 of web handle material 82 is mounted in the apparatus in any convenient position (in the illustrative embodiment it is mounted on one of the channel bars 64 of the box end storage station) and its free end passes through subframe 82 over a pair of rollers 86 for positioning along the leading edge 26 of a box end blank positioned immediately therebelow. The supply can be located in any convenient position, e.g. it can be a large reel on the floor, and then a guide roller for the web would be located at the upper end of the channel bar 64.

The web material is drawn through subframe 82 by a pinch roller or wheel 88 which cooperates with the roller 86. The roller 88 has a serrated periphery 90, including a peripheral groove 92 formed intermediate its sides, which engages the web 18 and holds it against roller 86. The groove 92 accommodates a fixed support bar 94 (see FIG. 4*a*) mounted in the apparatus and passing between the rollers 88, 86. This support bar helps in keeping web material 18 straight as it passes through the rollers. Since the supply 84 of web material 18 is preferably free wheeling, in order to maintain a proper tension on the web material as it is drawn through the pinch rollers a leaf spring 102 is mounted on subframe 82 and engages the web material as it passes over the upper roller 86.

Pinch roller 88 is rotatably mounted in subframe 82 on a shaft 96 and is driven by a belt or chain drive 98, in any convenient manner, from the end sprocket wheel 100 of conveyor 56 (see FIG. 3). In this manner roller 88 is driven in synchronism with conveyor 56.

Preferably a portion 104 of the peripheral surface of pinch roller 88 is cut away, as seen in FIG. 4, so that the roller drives the web material only during a portion of its rotation. In this manner, a predetermined length of web material can be supplied to a box end blank 18 carried on conveyor 56 located immediately below the web supply station and movement of the web material will be momentarily stopped although the drive of the apparatus is continuous.

In commencing operation the apparatus is initially arranged with the edge portion 106 of pinch roller 88 positioned adjacent the lower roller 86, with the free end 24 of the web material 18 positioned therebetween. In this position, at the beginning of the operation, there would be no box end blank below subframe 82, and the conveyor would at that point be just receiving a box end blank 12 from storage station 16. Upon commencing operation of the conveyor, the conveyor is moved forwardly so that the box end blank is moved from storage station 16 to the web supply station 80. The simultaneous synchronous rotation of pinch roller 88 draws the web material downwardly so that the free end 24 thereof is placed in front of and below the leading edge 26 of the box end blank.

Preferably the subframe 82 includes a pair of pins 106 directly below the back up support bar 94 so as to engage and hold the end portion 24 of the web material, instantaneously, as described hereinafter. In addition, as seen most clearly in FIG. 4 it is preferable that the subframe 82 and, in particular, the web support bar 94 be inclined from the vertical, away from the direction of travel of the conveyor 56, so that as the web material moves downwardly it rests under the influence of gravity on the support bar 94 and its bottom end 24 hangs vertically in front of the leading edge 26 of the box end blank 12.

In order to synchronously cut the web material 18 to the desired handle length, a cutter mechanism 110 is provided at web supply station 80. This mechanism includes a cutter drive bar 112 which is pivotally mounted on subframe 82 by a pivot pin 114 in any convenient manner. It is noted that pivot pin 114 is located forwardly of the axis of rotation of shaft 96 of pinch roller 88, for reasons to be presently described.

Cutter drive bar 112 has a drive pin 116 rigidly secured thereto and received in a lost motion slot 118 on a cutter bar 120. The latter is received in a lost motion slot 118 on a cutter 122 and includes a tapered cutting edge 124. Mandrel 122 includes an aperture 126 formed therein to allow the web 22 to pass through it directly in front of the cutter blade 120. Likewise support bar 94 has an opening 128 formed therein to permit the cutter bar 120 to pass therethrough during its cutting stroke. The drive pin mounting arrangement 116 is located to abut a stop bolt 130 mounted on subframe 82 in any convenient manner, in order to limit the leftmost position of cutter drive bar 112. It is noted that the bar is biased to the position illustrated in FIG. 4 in solid lines by a spring 132 connected between the bar and subframe 82.

In order to advance cutter bar 120 to cut web 22, pinch roller 88 includes a drive cam 134 mounted thereon which has a cam surface portion 136 which extends beyond the periphery of the pinch roller. This cam element is adapted to engage a drive block 138 mounted on the inner face of cutter drive bar 112. (i.e. the inside of bar 112 as seen in FIG. 4). In this manner, as pinch roller 88 rotates the leading edge 136 of cam block 134 will reach the position illustrated at the upper left hand corner in FIG. 4 in dotted lines, at which position surface 136 will engage block 138. Continued rotation of pinch roller 88 will of course carry cam 134 with it, and this will cause surface 136 to push against block 138 and thus pivot arm 112 in a generally clockwise direction about pivot pin 114. This will thus move cutter bar 120 forwardly (i.e. to the right as seen in FIG. 4) in order to cut web material 18 at a predetermined height above box end blank 12 to form the second end portion 33 of the cut web handle section and a new free end portion 32 of the web supply 18. Ultimately continued rotation of pinch roller 88 causes cam 134 to move arm 112 to a position wherein the cam is released and can pass below the drive or contact block 138. That is, because the pivot axis 114 of arm 12 is located forwardly of the axis of rotation 96 of pinch roller 88, and because the radius of arm 112 is greater than the radius of the pinch roller, a position will ultimately be reached where surface 136 can pass under block 138. This is illustrated in dotted lines at the top right of FIG. 4. Once block 138 is freed in this manner arm 112 returns to its original position under the influence of spring 132.

It is noted that the lower end 140 of arm 112 includes an extension piece 142 including a transverse plate 143 (see FIG. 5) that moves with arm 112 from the solid line position to its dotted line position in FIG. 4 as arm 112 swings in its cutting motion. As a result the inner face of plate 143 will engage the free end portion 24 of the web handle and urge it against pins 160, in order to secure the web on the pins so that the web is in proper position for engagement by the transport mechanism of the conveyor as described hereinafter. Extension 142 also includes a spring 144 which will engage a portion 82' of frame 82 when the arm 112 has been rotated to the cutting position. Once arm 112 is engaged by cam 134 spring 144 initiates rotation of the arm back to its original position. A cushion block 144 formed of rubber or the like is mounted on extension 142 on the side of stop portion 82' of subframe 82 which is opposite spring 144. The cushion block limits counterclockwise rotation of arm 112 under the influence of spring 132 to the position shown in dotted lines in FIG. 4. The cushion block also reduces noise or return of arm 112.

In order to transport the upper cut end 33 of the cut web handle section from its position above the box end blank to the front edge 26 of the box end blank, a transport mechanism 150 is provided. This mechanism includes a shaft element 152 which is rotatably and translatably mounted in subframe 82 for motion transverse to the direction of travel of the conveyor. The free end 154 of shaft 152 includes a carrier arm 156 rigidly mounted thereon transverse to the axis of rotation.

Arm 156 has a free end 158 on which pins 160 are mounted. The pins face the web material 18 when the arm is moved to the position shown in phantom lines in FIGS. 4 and 5. These pins are driven into the web material as the cut in the material is being completed. In order to insure that pins 160 penetrate the web material apertures 162 can be formed in the support bar 94. Penetration of the material insures that the end 33 of the cut web handle section will be carried with arm 156 when it is rotated.

In order to move the web handle end portion 33 from its uppermost position adjacent the cutting mechanism, at the completion of the cut, arm 156 is rotated in a clockwise direction in FIG. 4, and out of the drawing of FIG. 5 (i.e. from the phantom line position at the left in FIG. 5 forwardly to to the solid line position thereof) while being translated laterally from left to right in FIG. 5. This rotary and lateral movement causes the web handle end 33 to be translated in an arcuate path to a position adjacent the front edge 26 of a container end blank 12 immediately below the web supply station. This movement simultaneously forms a moebius type twist in the web handle since the outer face of the web material at the end 33 is positioned adjacent the inner edge 26 of the box, so that, in effect, opposite sides of the web material at the ends 24, 33 are adjacent the edge 26 of the box, thus causing a moebius type twist to be formed intermediate these ends in the handle.

In order to rotate and translate web end 33 in this manner, the translation mechanism 150 includes a shaft 166 which is an extension of shaft 96 of pinch roller 88. This shaft includes a sprocket 168 which cooperates with the chain drive 98 which synchronously rotates shaft 166 and pinch roller 88 with conveyor 56. The opposite end 170 of shaft 166 includes a crank element 171 rigidly secured thereto for rotation therewith. This crank element is pivotally connected as at 172 to a pitman 173. The opposite end of pitman 173 is pivotally connected to the arm 178 of a bell crank 180. The latter is pivotally connected at 182 on subframe 82 in any convenient manner while its other end 184 is pivotally connected to a bushing 188 through a lost motion slot 186 formed in the arm. Bushing 188 is rotatably mounted on the inner end 190 of shaft 152 and has a pin 191 which is received in the lost motion slot 186. In this manner, rotation of shaft 166 causes the bell crank to oscillate from its solid to its phantom line position in FIG. 5, thus translating shaft 152 transversely of conveyor 56.

In order to cause rotation of shaft 152 a hollow sleeve 192 is rigidly mounted in frame 182 in any convenient manner. This sleeve includes a generally helical slot 194 which receives a roller 196 rotatably mounter on shaft 152. By this arrangement when shaft 152 is translated laterally, as in FIG. 5, roller 196 will be guided in slot 194 and cause shaft 152 to rotate. Since bell crank 180 is driven by the same shaft 166 as pinch roller 88, the cutting and translating movements of the web are synchronized. By this arrangement then the web 18 supplied to station 80 is cut and then translated so that the cut 33 is adjacent the leading edge 26 of a box end immediately therebelow.

In order to move the unsecured handle which has thus been positioned along the leading edge 26 of the container blank end 12 from the web supply station to the stapling machine without disturbing the positioning of the handle, the conveyor is provided with a clamping mechanism which holes the end portions of the handle in a fixed position during this movement.

Figures 6A, 6B, 6C:
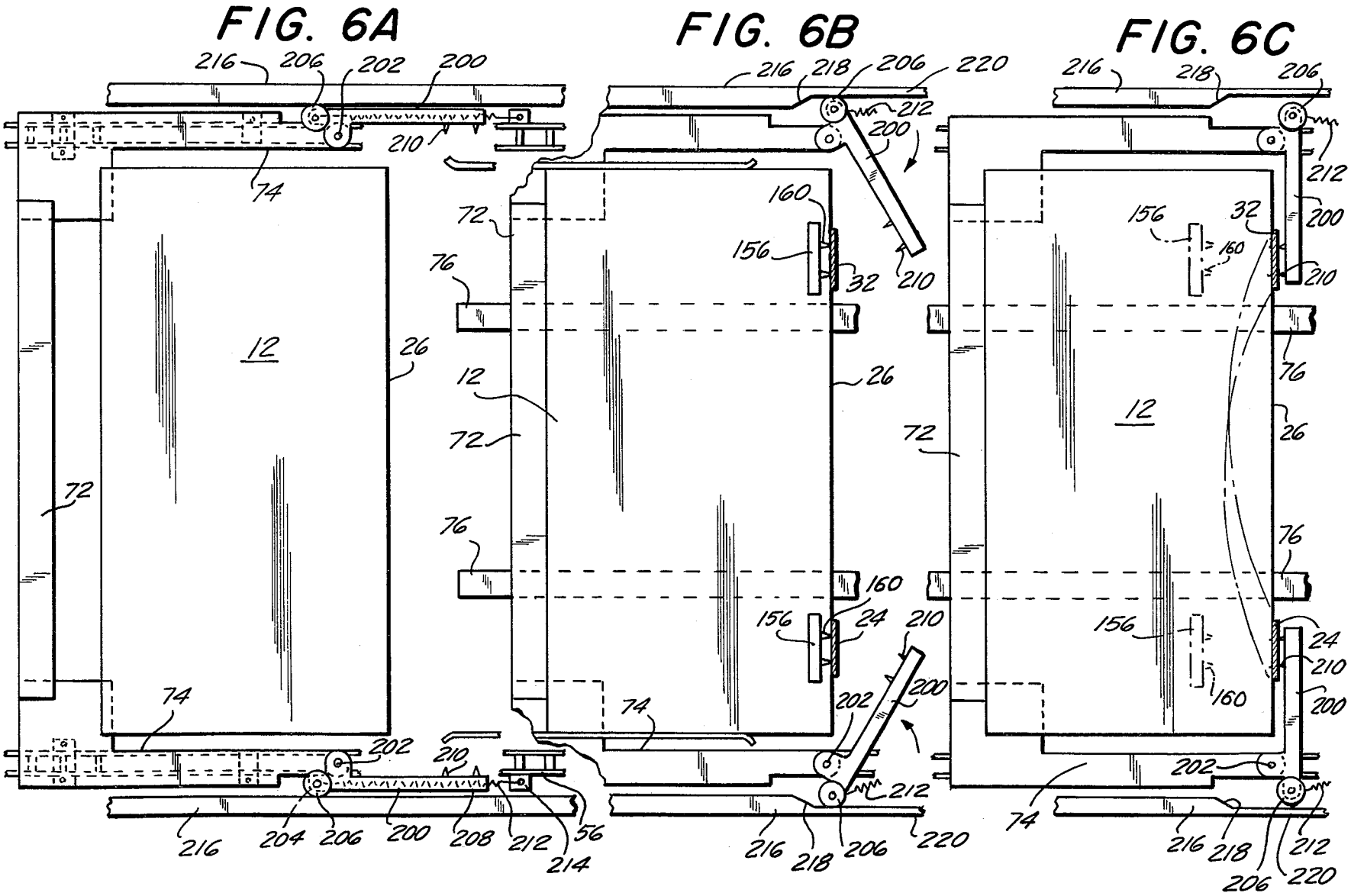
Figures 6D, 6E, 6F:
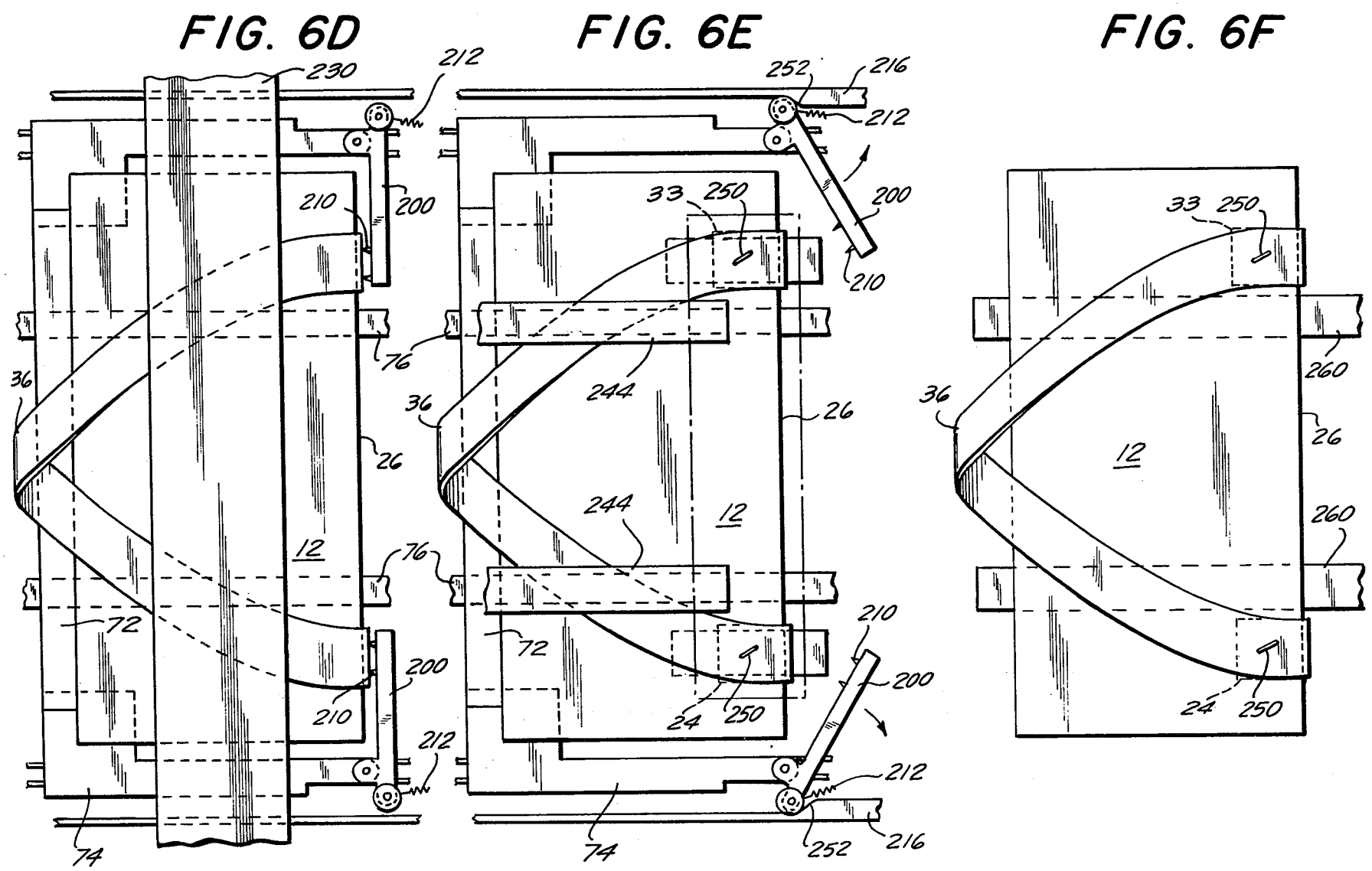

As seen in FIG. 6A (which illustrates the conveyor arrangement at the storage station 16) the conveyor mounting bars 74 have clamping arms 200 pivotally mounted thereon at 202 on opposite sides of the conveyor and spaced so as to receive the container end blank 12 therebetween. These clamping bars have rear end portions 204 on which cam rollers 206 are rotatably mounted. Their opposite ends 208 carry on their inner surface pins 210 which, as described hereinafter, are adapted to engage the web material. Finally, arms 200 are normally biased into a position transverse of the conveyor by springs 212 which are connected between the end 204 of the arms and mounting blocks 214 on the chain conveyor 56. These blocks are located forwardly, in the direction of the conveyor, of the pivot 202.

Arms 200 are maintained in their opened position illustrated in FIG. 6A, at the storage station 16, by cam bars 216 located along sides of the frame 52. Rollers 202 engage these cam bars so that arms 200 are held in their open position against the influence of the springs 212. Thus the clamping bars 200 are out of the way when the conveyor passes through the storage station, and they do not interfere with the removal of the lowermost blank 12 from the stack blanks. Cam bars 216 keep arms 200 in their opened position until after the ends 24, 33 of the cut web handle section have been positioned.

It is to be understood that throughout the entire sequence of operation of the apparatus the conveyor is continuously moving, and the various operations occur relatively rapidly. Thus, in FIG. 6B there is illustrated a configuration of the apparatus immediately after arm 156 has been translated from its upper vertical position to its lower position. In this configuration the end 24 of the box web handle section is engaged with the pins 106 on subframe 82, as previously described, while the end 33 is engaged with the pins 160 on arm 156. However, these pins 160, 106 do not move forwardly with the conveyor, but rather are in a relatively fixed position as seen in FIG. 6B. In the next instant after the position illustrated in FIG. 6B the bos end blank 12 will have been moved more towards the right in the drawing while pins 106, 160 will remain in the same position.

Clamp bars 200 serve to hold the web against the edge of the container blank, so as to aid in stripping the web from the pins 106, 160 and cause it to move with the container end blank. Accordingly, cam bars 216 are designed to release rollers 206 on clamping bars 200 just after the conveyor position at which arm 156 has reached its lowermost position. This is achieved by providing ramp sections 218 in bars 216 which lead to narrower sections 220 in the bars. As a result, springs 212 will pull clamping bars 200 into their closed and clamping position. The bars 200 drive their pins 210 against web end 24, 33 and hold those ends against the leading edge 26 of the container end blank. Since the clamp bars 200 move with the conveyor, and thus with the box end section 12, the web handle is held in a fixed position on the box end section and is stripped from the pins 106, 160, as seen in FIG. 6C, wherein the container end blank 12 has moved more towards the right with the conveyor while the bar 156 and pins 106 remain in their original position, shown in phantom lines.

Between web supply station 80 and stapling machine 54, a cross or pressing bar 230 is provided (see FIGS. 3 and 6D) which overlies the path of travel of the conveyor. The purpose of this bar is to push the twisted moebius handle section down against the top surface of blank 12, so that it lies relatively flat against the end blank and will not interfere with the stapling machine action. During this portion of the movement of the end blank, the web handle is held against the leading edge 26 of the end blank by the clamping arms 200, as previously described, with the extreme free ends thereof dangling downwardly below the blank, as seen in FIG. 2.

As the end blank 12 approaches the stapling machine it passes over the leading edge 240 of the clinching mechanism 242 conventionally provided in stapling machines. This movement causes the dangling ends of the handle section to be folded upwardly against the lower surface of the box end blank so that they overlie over the clinching mechanism.

The stapling machine 54 is provided with a pair of presser arms 244 (see FIGS. 3 and 6E) which extend downwardly to free ends 245 which engage the end blank before it passes beneath the stapling head. These pressure arms drag the web 14 back from the clamp pins 210 to shape the web into a straight sided U-shape in plan so that the webbing on the upper surface of the end blank directly over the ends of the webbing which have been folded over end blank 12 so that a single staple in each of the webbing will penetrate both the upper and lower ends of the webbing and attach them to the end blank 12.

The position of the staples in the webs with respect to the leading edge of the end blank is determined by contact switches 247 located along the path of travel of the blanks. The switch detects the passage of an end blank and cycles the stapling machine to drive staples 42 into the web material. These staples penetrate the web material at the top surface of the end blank, pass through the wooden blank, and then penetrate the end portions of the cut handle section which have been folded under the blank. As a result the web handle 14 is securely fastened to the blank 18, by staples 42 as seen in FIG. 8.

Since the web handle is secured to the blank at this instant it is no longer necessary to hold the web with the clamping arms 200. Thus, these arms are preferably pivoted out of the way. Accordingly the width of cam bars 216 is increased by providing inclined cam sections 252, so that the arms 200 will be swung back away from the end blank. The blank can then drop off of the conveyor down a chute 260, in any convenient manner into a storage area or the like.

Clamping arms 200 can be held in their opened position by the cam bars 216 as they return along the lower flight of the conveyor to the storage area by simply extending the bars 216 along the entire run of the conveyor. However, preferably, bars 216 terminate in a position located beyond the point at which the end blanks are discharged from the conveyor, for example adjacent the vertical flight 270 of the conveyor at the right in FIG. 3, so that arms 216 will naturally close under the influence of their associated springs 212. However, when the arms re-approach the storage station 16 cam bars 216 commence and open arms 200 so as to insure that they do not interfere with the removal of the lowermost blank from the storage stack.

Accordingly, it is seen that a relatively simply constructed and durable device is provided which will permit a flexible web handle to be secured to a resawn lumber end blank or box end section with a moebius type twist. This twisting and securing operation is performed entirely automatically in synchronized continuous operation which is very reliable in use.

Although an illustrative embodiment of the present invention has been described herein with reference to the accompanying drawings, it is to be understood that the invention is not limited to that precise embodiment, but that various changes and modificcations can be effected therein by those skilled in the art without departing from the scope or spirit of this invention.

What is claimed is:

1. A device for securing a web handle to a blank comprising a conveyor, a feed station including means for storing a supply of blanks, said conveyor including means for removing individual blanks from said feed station and carrying the blanks therewith, with one edge of the blanks facing in the direction of travel of the conveyor; a web handle supply station downstream of said feed station in the direction of travel of said conveyor including means for supplying and positioning a web handle of predetermined length to a blank immediately therebelow with the ends of said web handle located in front of said one edge of the blank; and means for securing said web to the blank.

2. A device as defined in claim 1 wherein said web handle has first and second sides and said supplying and positioning means includes means for positioning the first side of the handle at one end and the second side of the handle at its other end adjacent said one end of the blank whereby the handle has a moebius twist therein to provide a flat handle surface.

3. A device as defined in claim 2 wherein said web handle supplying and positioning means includes means for cutting a continuous supply of web handle material into predetermined lengths.

4. A device as defined in claim 2 wherein said conveyor includes means for holding the web against said one end of the blank as the blank is transported by the conveyor from said supplying and positioning means to said securing means.

5. A device as defined in claim 4 wherein said blanks each have upper and lower surfaces; said securing means including means for folding the end portions of the web handle over said one end on said upper and lower surfaces and for securing the web to the blank through the portions of the handle overlying said upper and lower surfaces.

6. A device as defined in claim 5 wherein said securing means comprises a wire bound box stapling machine and said folding means comprises the lower staple clincher of the stapling machine and a pusher element above the path of travel of the blank in front of the stapling machine's former-driver element for pushing the web handle down onto the upper surface of the blank.

7. A device for securing a web handle to a box end blank comprising a feed station including means for storing a supply of box end blanks in a stack with said end blanks lying substantially horizontally; a conveyor for transporting individual blanks through said device including means for sequentially removing the lowermost blank from said stack and carrying said blanks therewith; a web handle supply station downstream of said feed station in the direction of travel of said conveyor including means for supplying web handle material to the supply station in a generally vertical direction, with the free end of the material positioned adjacent one end of a blank immediately therebelow; means for sequentially cutting the material into sections of predetermined length by cutting the material at a predetermined distance above the blank to form a new free end of the web handle material and a second free end on the cut handle section, and means for engaging said second free end of the cut handle section and transporting it vertically downwardly to a position adjacent said one end of the blank while simultaneously forming a moebius twist in said cut handle section; and means downstream of said supply station for securing the cut web handle section to the blank.

8. A device as defined in claim 7 wherein said engaging and transporting means includes a shaft rotatably mounted in said device transverse to the vertical path of travel of said web material, a pick up arm rigidly secured to said shaft for rotation therewith and extending generally perpendicular thereto, said pick up arm including means for removably securing said second end of the cut web handle section thereto; and means for rotating said shaft about its axis of rotation while translating the shaft axially along said axis of rotation, thereby to move said second end of the cut web handle from adjacent said cutting means to a position adjacent said one end of the blank while simultaneously twisting the cut web handle section moebiusly.

9. A device as defined in claim 8 wherein said engaging and transporting means includes a frame, said shaft being rotatably mounted in said frame and said means for rotating and translating said shaft including a rotating crank, a bell crank pivotally mounted on said frame, a pitman operatively connected between said rotating crank and one end of the bell crank; said bell crank being connected at its other end through a lost motion connection to the shaft whereby rotation of the rotating crank translates said shaft axially along its axis of rotation; and a fixed hollow sleeve mounted in said frame and having a generally spiral shaped slot formed therein; said shaft having a guide element mounted thereon and received in said slot whereby said slot and guide element cooperate during translation of said shaft to cause said shaft to rotate.

10. The device as defined in claim 9 wherein said guide element is a roller.

11. The device as defined in claim 7 wherein said engaging and transporting means includes a frame; a pair of cooperating rollers mounted on said frame adjacent the generally vertical path of travel of the web material, on opposite sides thereof to grasp the web material therebetween; and means for rotating one of said rollers to draw the web material from a source thereof and supply it downwardly to position the free end of the web material adjacent one edge of a blank therebelow.

12. The device as defined in claim 11 wherein said one roller has a cut out section formed therein of predetermined configuration whereby the roller draws said web material therewith only through a portion of each revolution thereof.

13. The device as defined in claim 11 wherein said frame is inclined to the vertical away from the securing means and includes a support surface for the web below said cutting means, said support surface being inclined with the frame whereby the web material rests thereon and, at the bottom of the support surface, hangs vertically in part of said one edge of the blank.

14. The device as defined in claim 11 wherein said cutting means includes a cutter support bar rotatably mounted on said frame, a cutter bar conneced to said support bar through a lost motion connection; a hollow fixed mandrel mounted in the frame slidably receiving said cutter bar therein and having an opening therethrough formed along the path of travel of the web material to allow the web material to pass therethrough, and means for oscillating said support bar to drive the cutter bar through the mandrel and cut the web material therein.

15. The device as defined in claim 14 wherein said support bar has an upper end portion including a fixed cam element extending therefrom; said one roller including a cam element mounted thereon for movement therewith along a path of travel to engage said fixed cam element and rotate said support arm therewith from a first to a second position, said cam elements being located with respect to each other in predetermined positions to disengage each other after a predetermined angular rotation of the support arm.

16. The device as defined in claim 15 including spring means for returning the support arm to its first position, and stop means for operatively engaging said support arm to define said first position thereof and prevent further rotation of said support arm under the influence of said spring.

17. The device as defined in claim 8 wherein said conveyor includes means for holding the web against said one end of the blank as the blank is transported by the conveyor from said web handle supply station to said securing means.

18. The device as defined in claim 17 wherein said holding means comprises a pair of clamp arms pivotally mounted on the conveyor on opposite sides thereof; spring means on said conveyor for normally biasing said arms transversely of the conveyor in alignment with each other to hold the end portions of the cut web handle section against said one edge of the blank.

19. The device as defined in claim 18 wherein said clamp arms and device include cooperating means for pivoting the support arms into open positions parallel to the conveyor against the bias of the spring means when the arms are adjacent the web handle supply station to allow said end portions of the cut web handle to be positioned adjacent the one edge of a blank on the conveyor; said cooperating means releasing said arms after the ends of the cut web handle section are positioned adjacent said one edge portion of the blank thereby to hold the end portions of the cut web handle section against the blank as the blank is moved by the conveyor from said web handle supply station to said securing means.

20. The device as defined in claim 7 wherein said blanks each have upper and lower surfaces and securing means for folding the end portions of the web handle over said one end on said upper and lower surfaces and for securing the web to the blank through the portions of the handle overlying said upper and lower surfaces.

21. The device as defined in claim 20 wherein said securing means comprises a wire bound box stapling machine and said folding means comprises the lower staple divider of the stapling machine and a pusher element above the path of travel of the blank in front of the stapling machine's former-driver element for pushing the web handle down onto the upper surface of the blank.

22. A device for securing a web handle to a box end blank comprising a feed station including means for storing a supply of box end blanks in a generally vertically extending stack with the blanks lying face to face; a conveyor for transporting individual blanks through said device including means for sequentially removing the lowermost blank from said stack and carrying said blanks therewith through the device; a web handle supply station downstream of said storage station in the direction of travel of said conveyor including a frame, means on said frame defining a generally vertical path of travel through said supply station for web handle material from a supply thereof, a pair of cooperating rollers mounted on the frame adjacent the path of travel of the web material, on opposite sides thereof to grasp the web material therebetween, and means for rotating one of said rollers to draw the web material from the source thereof and supply it downwardly along said path of travel to position the free end of the web material adjacent the one edge of the blank therebelow facing in the direction of travel of the conveyor;

means mounted on said frame for cutting the web material into sections of predetermined length by cutting the material at a predetermined distance above the blank to form a new free end of the web handle material and a second free end on the cut handle section;

means for engaging said second free end of the handle section and transporting it vertically downwardly to a position adjacent said one end of the blank while simultaneously forming a moebius twist in the cut handle section including a shaft rotatably mounted in said frame transverse to the generally vertical path of travel therethrough, a pick up arm rigidly secured to said shaft for rotation therewith and extending generally perpendicular thereto, said pick up arm including means for removably securing said second end of the cut web handle section thereto; and means for rotating said shaft about its axis of rotation while translating the shaft axially along said axis of rotation, thereby to move said second end of the cut web handle from adjacent said cutting means to a position adjacent said one end of the blank while simultaneously twisting the cut web handle section in a moebius type twist; and means downstream of said supply station for securing the cut handle section to the blank.

23. The device as defined in claim 22 wherein said shaft is rotatably mounted in said frame and said means for rotating and translating said shaft including a rotating crank, a bell crank pivotally mounted on said frame, a pitman operatively connected between said rotating crank and one end of the bell crank; said bell crank being connected at its open end through a lost motion connection to the shaft whereby rotation of the rotating crank translates said shaft axially along its axis of rotation; and a fixed hollow sleeve mounted in said frame and having a generally spiral shaped slot formed therein; said shaft having a guide element mounted thereon and received in said slot whereby said slot and guide element cooperate during translation of said shaft to cause said shaft to rotate.

24. The device as defined in claim 23 wherein said cutting means includes a cutter support bar rotatably mounted on said frame, a cutter bar connected to said support bar through a lost motion connection; a hollow fixed mandrel mounted in the frame slidably receiving said cutter bar therein and having an opening therethrough formed along the path of travel of the web material to allow the web material to pass therethrough, and means for oscillating said support bar to drive the cutter bar through the mandrel and cut the web material therein.

25. The device as defined in claim 24 wherein said support bar has an upper end portion including a fixed cam element extending therefrom; said one roller including a cam element mounted thereon for movement therewith along a path of travel to engage said fixed cam element and rotate said support arm therewith from a first to a second position, said cam elements being located with respect to each other in predetermined positions to disengage each other after a predetermined angular rotation of the support arm.

26. The device as defined in claim 25 includng spring means for returning the support arm to its first position, and stop means for operatively engaging said support arm to define said first position thereof and prevent further rotation of said support arm under the influence of said spring.

27. The device as defined in claim 26 wherein said conveyor includes means for holding the web against said one end of the blank as the blank is transported by the conveyor from said supplying and positioning means to said securing means.

28. The device as defined in claim 27 wherein said holding means comprises a pair of clamp arms pivotally mounted on the conveyor on opposite sides thereof; spring means on said conveyor for normally biasing said arms tranversely of the conveyor in alignment with each other to hold the end portions of the cut web handle section against said one edge of the blank.

29. The device as defined in claim 28 wherein said clamp arms and device include cooperating means for pivoting the support arms into open positions parallel to the conveyor against the bias of the spring means when the arms are adjacent the supply station to allow said end portions of the cut web handle to be positioned adjacent the one edge of a blank on the conveyor; said cooperating means releasing said arms after the ends of the cut handle section are positioned adjacent said one edge portion of the blank thereby to hold the end portions of the cut web handle section against the blank as the blank is moved by the conveyor from said supply station to said securing means.

* * * * *